US005299510A

United States Patent [19]

Mattesky

[11] Patent Number: 5,299,510

[45] Date of Patent: Apr. 5, 1994

[54] COLLAPSIBLE, HEIGHT ADJUSTABLE IRONING BOARDS

[75] Inventor: Henry Mattesky, Cedar Grove, N.J.

[73] Assignee: Herbert Glatt, Morristown, N.J.

[21] Appl. No.: 5,142

[22] Filed: Jan. 15, 1993

Related U.S. Application Data

[63] Continuation of Ser. No. 818,847, Jan. 10, 1992, abandoned.

[51] Int. Cl.[5] ..... A47B 3/02

[52] U.S. Cl. ..... 108/117; 108/120

[58] Field of Search ..... 108/117, 119, 120, 116, 108/115, 118; 38/103

[56] References Cited

U.S. PATENT DOCUMENTS

| | | | |
|---|---|---|---|
| 2,663,101 | 12/1953 | Olander | 108/117 |
| 2,667,102 | 12/1953 | Olander | 108/117 |
| 2,974,431 | 3/1961 | Ribaudo | 108/117 |
| 3,030,716 | 5/1962 | Boardman | 108/117 |
| 3,039,215 | 6/1962 | Boardman | 108/117 |
| 3,126,845 | 3/1964 | Ribaudo | 108/117 |
| 3,151,579 | 10/1964 | Steinwedel | 108/117 |
| 3,152,561 | 10/1964 | Munson | 108/120 |

*Primary Examiner*—Kenneth J. Dorner
*Assistant Examiner*—Gerald Anderson
*Attorney, Agent, or Firm*—Omri M. Behr; Matthew J. McDonald

[57] ABSTRACT

There is provided an ironing table of adjustable height and adapted to be collapsed during storage. This table is made up of a table member of predetermined width, having means for adjusting its height attached to its lower surface, as well as front and rear support means. These are made of a continuous piece of rigid tubing and are conveniently designated as three separate segments, namely a hollow tubular upper and lower leg member and a transverse hollow tubular foot member. One of the upper leg members is pivotally attached to said lower surface of the table member, the other being pivotally attached to the adjusting means. Both of the members being outwardly displaced from the longitudinal axis of the table member. The upper leg member, the lower leg member and the foot member of the rear support means lie in a common plane. Both of the support means are pivotally attached to each other at a point near where the upper and lower leg members join each other. The sides of the upper leg members and the lower leg members distal to the longitudinal axis of the table member subtending an angle of between about 130° and about 170° to each other and the sides of the lower leg members proximal to the longitudinal axis of the board and said foot members subtending an angle of between about 40° and about 80° to each other, provided the former of these angles shall be 90° greater than the latter.

5 Claims, 3 Drawing Sheets

COLLAPSIBLE, HEIGHT ADJUSTABLE IRONING BOARDS

This application is a continuation of application Ser. No. 07/818,847, filed Jan. 10, 1992 now abandoned.

BACKGROUND OF THE INVENTION

1. Field of the Invention

Collapsible, height adjustable ironing boards.

2. Discussion of the Prior Art

Ironing tables of adjustable height which can be collapsed during storage have been well known for decades. Tables which have been disclosed in the last 20 years generally include a table member of predetermined width, a front leg and a rear leg for supporting the table member connected thereto and a means for adjusting the height of the table. Many inventions have been made directed to the height adjusting means. Typical of these inventions are U.S. Pat. Nos. 2,974,431 and 3,126,845 to Ribaudo, 3,030,716 and 3,039,215 to Boardman 3,152,561 to Munson and 3,151,579 to Steinwedel. In all of these inventions the device further includes a transverse hollow tubular foot member for at least one of said legs wherein one of the legs is connected to the outer circumferential surface of said foot member, at a point proximate to but laterally displaced from the midpoint between the ends of said member. The reason for the lateral displacement will be clear from the illustrations of these inventions. The leg members must be collapsible on either side of the longitudinal axis of the table.

Due to the tedious nature of ironing many persons would like to watch television while ironing, and would prefer to do so whilst seated. This cannot be done with ironing tables having leg of conventional structure. It would be desirable therefor to provide such a table. Previous designs of tables to meet this requirement either had four legs or two legs in a T shaped design, which required welds or similar inconveniences of construction. Heretofore a two legged "non-T" structure has not been available.

SUMMARY OF THE INVENTION

There is provided an ironing table of adjustable height and adapted to be collapsed during storage comprising a table member of predetermined width having an upper and a lower surface, means for adjusting the height of said table attached to said lower surface and front and rear support means. These support means are of similar structure and mounted in a substantially mirror image manner to the table member. They comprise respectively, a hollow, tubular, upper and lower front leg member and a hollow, tubular, upper and lower rear leg member for supporting said table member. Each of said support means has a transverse hollow tubular foot member attached to said lower leg members as an integral part thereof.

One of said upper leg members is pivotally attached to said lower surface, the other being pivotally attached to said adjusting means. Both of said members being slightly outwardly displaced from the longitudinal axis of said table member, said upper leg member, said lower leg member and said foot member of the rear support means lying in a common plane. Both of said support means are pivotally attached to each other at a point close to the junction of said upper and said lower leg members.

The sides of said upper leg members and said lower leg members distal to said longitudinal axis of said table member subtend an angle of between about 130° and about 170° to each other and the sides of said lower leg members proximal to said longitudinal axis of said table member and the sides of said foot members proximal to said point of mutual attachment of said support members, subtend an angle of between about 40° and about 80° to each other provided the former of said angles shall always be 90° greater than the latter.

In a preferred embodiment the foot members further comprise cap means having a distal end and a proximal end with an opening therein, said opening circumferentially surrounding the ends of said foot members.

Furthermore it is desirable to additionally provide a stabilizer means mounted on each of said support means substantially at the location of the angle between the foot member and the lower leg member. This is so arranged that the distal end of this stabilizing means is in a common plane with the surface of said foot member distal from the point of mutual pivotal attachment of said support members when said leg pivotally attached to the adjusting means is sufficiently displaced from its fully collapsed position for the table to be usable and standing on a floor with said foot member in contact with said floor.

It will be clear to those skilled in the art that where the aforesaid stabilizer extends more than about 2 cm. from the edge of the foot member distal to the point of mutual pivotal attachement, the aforementioned relationship of the angles between the various leg members will also change to maintain stability. A similar effect is achieved by substantially thickening the caps on the ends of the foot member. Such modifications are within the scope of the present invention.

DESCRIPTION OF THE PREFERRED EMBODIMENTS

Since in the preferred embodiments the same structure is present in front port means 10 as is present in rear support means 11, only the former will be discussed in detail.

Figure 1:
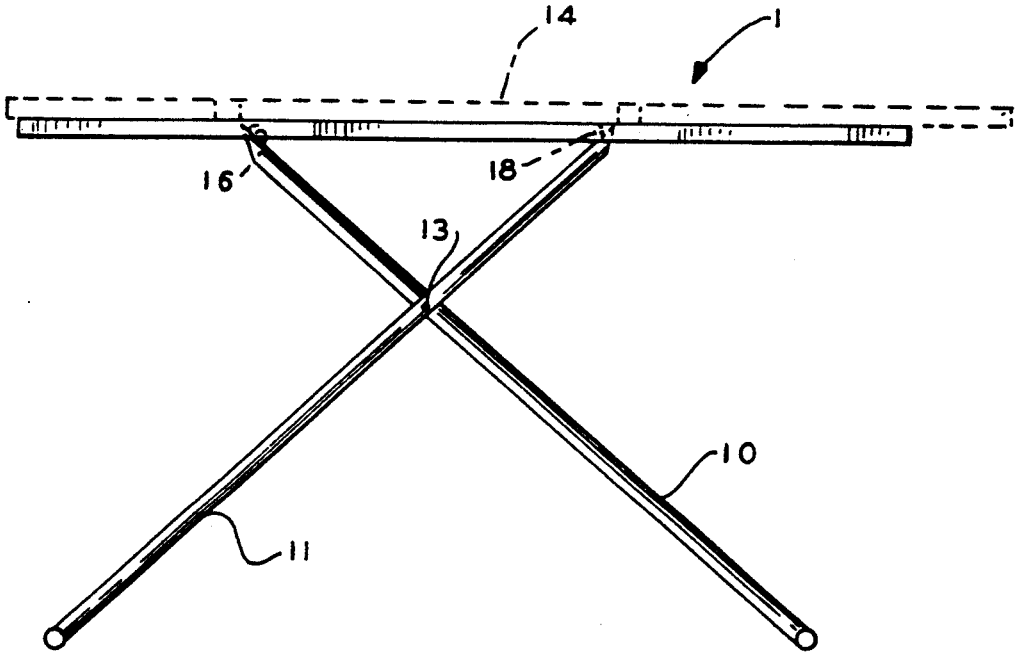
FIG. 1 is a side elevational view of an ironing board of the present invention, said board being shown as erected to medium height.
Figure 2:
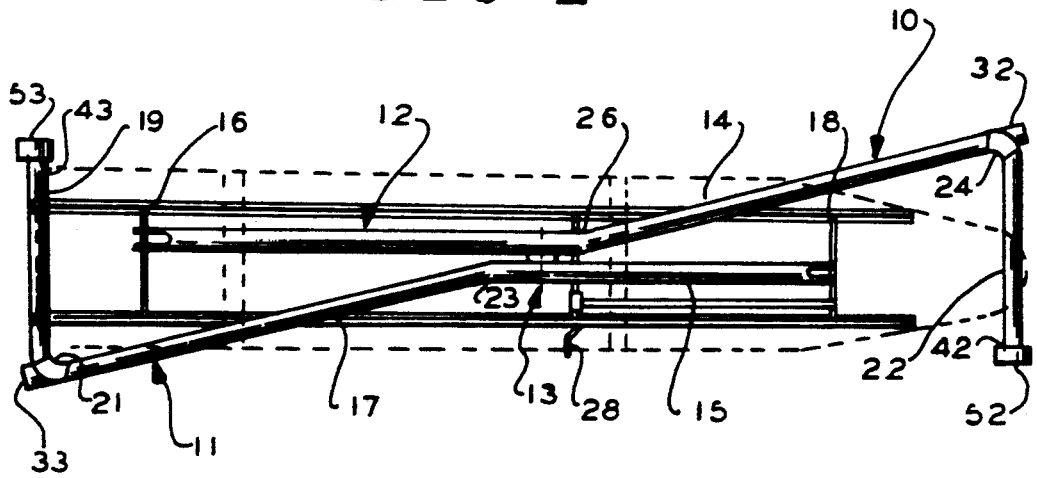
FIG. 2 is an upward plan view of the board of FIG. 1 in the collapsed state.
Figure 3:
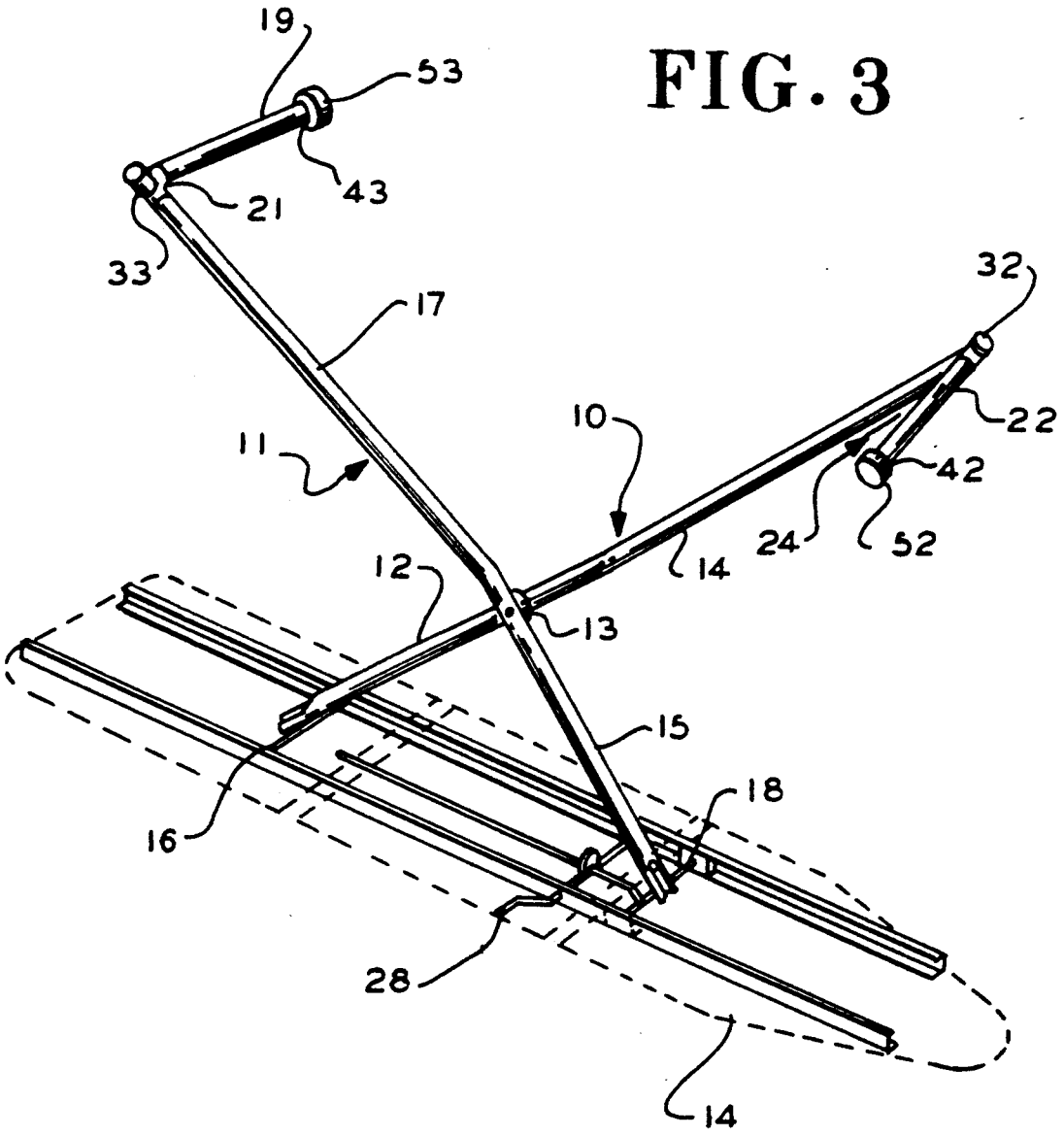
FIG. 3 is a downward perspective view of the board of FIG. 1 in the erected state, resting on the ironing surface.
Figure 4:
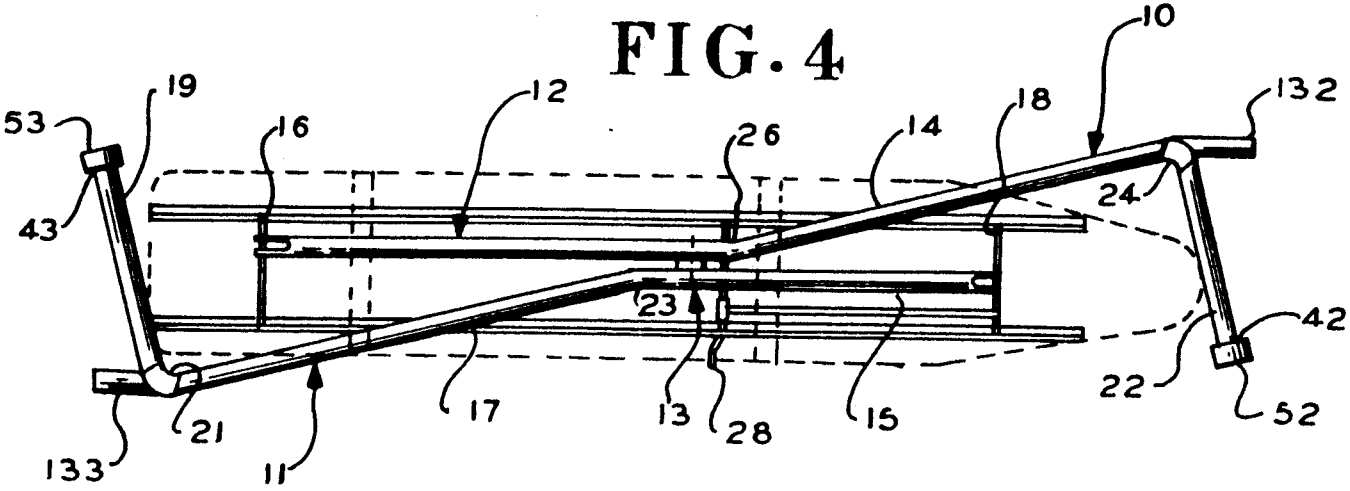
FIG. 4 is an upward plan view of a further embodiment of the board of FIG. 1 in the collapsed state showing an alternate orientation of the foot members.

Front support means 10 comprises a hollow tubular upper leg member 12, a lower leg member 14 and a foot member 22. The support means comprises a single piece of hollow tubing bent at points 26 and 24. The angle between upper leg member 12 and lower leg member 14 at point 26 is an obtuse angle of about 130° to about 170°. The angle between lower leg member 14 and foot member 22 at 24 is an acute angle of about 40° to about 80°. The angle at 26 will always exceed the angle at 24 by 90° (except as shown in the embodiments of FIGS. 4 and 5). Similarly rear support means 11 comprises upper leg 15, bend 23, lower leg member 17, bend 21 and foot member 19. The height setting device at 18 and 28 is one which is conventionally found in collapsible ironing boards.

In the preferred embodiments of the device the tabled is stabilized by end caps 52 and 53, placed at the ends 42 of foot member 22 and end 43 of foot member 19 respectively. In conjunction with two similar stabilizing means, one means 32, located at angle 24 and stabilizer 33 located at angle 21. The end of the stabilizer 32 distal to the point of mutual pivotal attachment 13, the surface of foot member 22 distal from said point 13 and the appropriate portion of the surface of cap 52, distal to said point 13, all lie substantially in the same plane. The term "substantially" is utilized because both the stabilizer 32 and the cap 52 have definite thicknesses and, in use, there may be a small amount of give in foot member 22. In practice however, whether the ironing board is set up on a carpeted floor or on a substantially smooth i.e. tiled or wooden, floor, all three surfaces act in mutual support to stabilize the board against traverse rocking. At the foot member 19 the mutual relationship of cap 53, foot member 19, and stabilizer 33 are the same. Stabilizers 32 and 33 may be rotated somewhat around the angle at which they are attached to obtain maximum stabilization.

Figure 5:
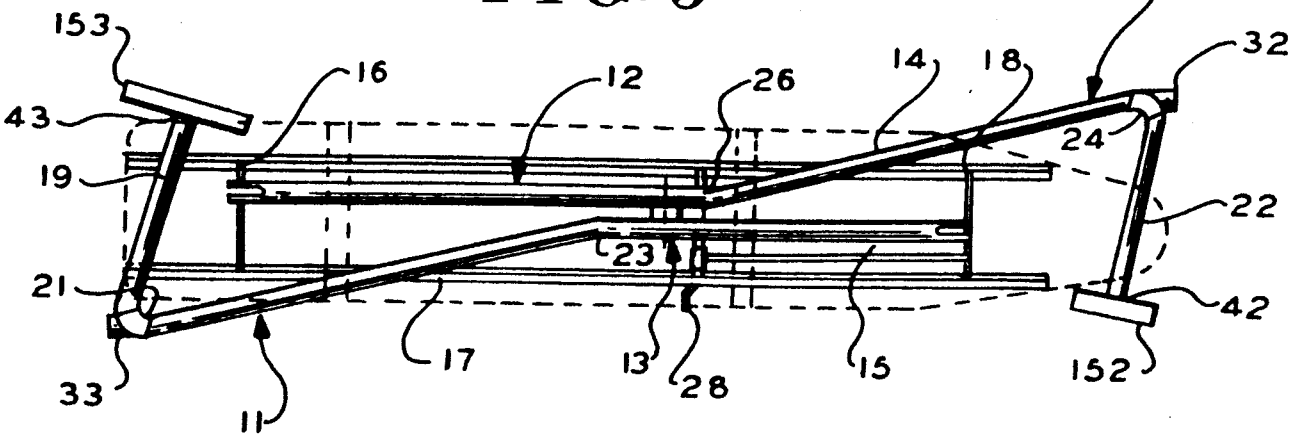
FIG. 5 is an upward plan view of yet a further embodiment of the board of FIG. 1 in the collapsed state showing an alternate orientation of the foot members.

While the general angular relationship of the leg and foot members is the preferred one discussed above, a similar effect can be achieved by the embodiment of FIGS. 4 and 5. In these embodiments the 90° difference in the relationship between the angles given above, can be increased or decreased by extending the length of the stabilizers 132 and 133 or the thickness of the end caps 142 and 143.

I claim

1. An ironing table of adjustable height and adapted to be collapsed during storage comprising:

a table member of predetermined width having an upper and a lower surface and a longitudinal axis;

an adjustable support junction attached to said lower surface; and front and rear support means for supporting said table member, each comprising:

(a) an upper and lower leg member joined at a leg junction, said upper leg member being supportively coupled to said table member, and (b) a transverse foot member attached to said lower leg member as an integral part thereof, said lower surface being pivotally connected to said upper leg member of a predetermined one of said support means, the upper leg member of another one of said support means, other than said predetermined one, being pivotally attached to said adjustable support junction, said front and rear support means being laterally displaced from the longitudinal axis of said table member, said upper leg member, said lower leg member and said foot member of the rear support means lying in a common plane, said front and said rear support means being pivotally attached together at one joint close to the leg junction of said upper and said lower leg members, said upper leg member and said lower leg member subtending an obtuse angle between about 130° and about 170°, said lower leg member and said foot member subtending an acute angle between about 40° and about 80°, provided said obtuse angle shall always be 90° greater than said acute angle, the lower leg of said front and rear support means extending from said one joint in opposite lateral directions.

2. The table of claim 1 wherein the foot member has an end distal from said lower leg member and further comprises a cap circumferentially surrounding the end of said foot member.

3. The table of claim 2 wherein said foot member and said lower leg member are joined at a joint, additionally comprising:

a pair of stabilizer means separately mounted on each of said support means substantially at the joint between the foot member and the lower leg member, said pair of stabilizing means are substantially in a common plane with the cap of each of said front and rear support means when said leg pivotally attached to the adjusting means is adjusted to bring the table, when standing, to a usable height.

4. An ironing table of adjustable height and adapted to be collapsed during storage comprising:

a table member of predetermined width having an upper and a lower surface, adjusting means for adjusting the height of said table attached to said lower surface, and front and rear support means for supporting said table member, comprising respectively:

a hollow tubular upper and lower front leg member and a hollow tubular upper and lower rear leg member for supporting said table member connected thereto, each of said support means having a transverse hollow tubular foot member attached to said lower leg members as an integral part thereof, a predetermined one of said upper leg members being pivotally attached to said lower surface and another one of said upper leg members, other than said predetermined one, being pivotally attached to said adjusting means, and both said support means being outwardly displaced from the longitudinal axis of said table member, said upper leg member, said lower leg member and said foot member of the rear support means lying in a common plane, both said support means being pivotally attached to each other at one joint close to the junction of said upper and said lower leg members, said upper leg member and said lower leg member subtending an angle of between about 130° and about 170° to each other and said lower leg member and said foot members subtending an angle of between about 40° and about 80° to each other, additionally comprising a stabilizer means mounted on each of said support means substantially at the location of the angle between the foot member and the lower leg member, the distal end of the stabilizer means being coplanar with the surface of said foot member distal from said one joint of said support means when said leg pivotally attached to the adjusting means is sufficiently displaced from a fully collapsed position for the table to be usable and standing on a floor with said foot member in contact with said floor, said stabilizers being of sufficient thickness that the ends thereof distal to said one joint of the support means extend to a plane parallel to both the upper surface of the table and the longitudinal axis of the table and contacting the end of said foot member distal to the said one joint of the said support means.

5. An ironing table of adjustable height and adapted to be collapsed during storage comprising:

a table member of predetermined width having an upper and a lower surface, means for adjusting the height of said table attached to said lower surface, and front and rear support means comprising respectively:

a hollow tubular upper and lower front leg member and a hollow tubular upper and lower rear leg member for supporting said table member connected thereto, each of said support means having a transverse hollow tubular foot member attached to said lower leg members as an integral part thereof, a predetermined one of said upper leg members being pivotally attached to said lower surface and another one of said upper leg members, other than said predetermined one, being pivotally attached to said adjusting means, and both said support means being outwardly displaced from the longitudinal axis of said table member, said upper leg member, said lower leg member and said foot member of the rear support means lying in a common plane, both said support means being pivotally attached to each other at one joint close to the junction of said upper and said lower leg members, said upper leg member and said lower leg member subtending an angle of between about 130° and about 170° to each other and said lower leg member and said foot member subtending an angle of between about 40° and about 80° to each other, additionally comprising end caps mounted on each of said foot members, said end caps having sufficient thickness that the surface thereof distal to the one joint of the support means extends to a plane parallel to both the upper surface of the table and the longitudinal axis of the table and contacting a point of junction of said foot member and said lower leg member distal to the one joint of the support means.

* * * * *